US006549058B1

(12) United States Patent
Bondarev

(10) Patent No.: US 6,549,058 B1
(45) **Date of Patent: *Apr. 15, 2003**

(54) SIGNAL PROCESSING CIRCUITS FOR MULTIPLICATION OR DIVISION OF ANALOG SIGNALS AND OPTICAL TRIANGULATION DISTANCE MEASUREMENT SYSTEM AND METHOD INCORPORATING SAME

(75) Inventor: Vadim Bondarev, Bellevue, WA (US)

(73) Assignee: Banner Engineering Corporation, Plymouth, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/948,736

(22) Filed: Oct. 10, 1997

(51) Int. Cl.[7] ..... G06G 7/16
(52) U.S. Cl. ..... 327/356; 327/94; 327/360
(58) Field of Search ..... 327/91, 93, 94, 327/96, 100, 337, 355–360

(56) References Cited

U.S. PATENT DOCUMENTS 3,784,803 A * 1/1974 Brendle ..... 327/360
4,350,441 A * 9/1982 Wicnienski ..... 327/360
5,416,439 A * 5/1995 Shou et al. ..... 327/360

* cited by examiner

*Primary Examiner*—Kenneth B. Wells
(74) *Attorney, Agent, or Firm*—Merchant & Gould P.C.

(57) ABSTRACT

Circuits and methods for generating signals representing the division or multiplication of two analog signals are incorporated into optical triangulation distance measurement systems. In one embodiment one of two analog voltage signals is used to generate a current signal. A capacitor is charged by the current signal. The voltage on the capacitor is compared with the other analog voltage signal and a signal is generated that has a time interval representing the division of the two analog voltage signals. In the application of the circuit and method to optical triangulation distance measurement the time interval signal is further processed to obtain distance measurement to a target.

5 Claims, 5 Drawing Sheets

SIGNAL PROCESSING CIRCUITS FOR MULTIPLICATION OR DIVISION OF ANALOG SIGNALS AND OPTICAL TRIANGULATION DISTANCE MEASUREMENT SYSTEM AND METHOD INCORPORATING SAME

FIELD OF THE INVENTION

The present invention relates generally to a signal processing circuit and method for generating signals representing the division or multiplication of two analog signals. The signal processing circuit and method of the present invention has particular application in the field of optical triangulation distance measurement. More particularly, the present invention has application to photoelectric optical distance measurement utilizing a photoreceiver which generates two analog signals based upon the position of a light beam reflected from a target onto the photoreceiver and wherein the two analog signals contain information relating to the distance from the photoreceiver means to the target.

BACKGROUND OF THE INVENTION

There may be numerous signal processing applications where either the division or multiplication of two analog signals is desired. The signal processing circuits and methods of the present invention could be applicable in any one of such applications; however, they find particular application in the field of optical triangulation distance sensing.

An illustration of optical triangulation distance measurement system is shown diagrammatically in FIG. 1. A light source comprising a light emitting diode (LED) 10 emits a pulsed light beam that is collimated along its optical axis and directed toward a target or object T. With the target T at the position X1 from LED 10, a portion of the pulsed light beam is reflected back to a photoreceiver means such as a position sensitive detector (PSD) 12, which is also referred to in the art as a lateral effect photodiode. The reflected light beam strikes the surface of the PSD 12 at the position Y1. PSD 12 converts the photon light energy striking its surface into two electrical current signals, I1 and I2 at two of its output terminals. The current signals, I1 and I2, contain information relative to the position where the reflected light beam impinges upon the surface of PSD 12. Accordingly, the current signals I1 and I2 contain information relating to the distance X1. When the position of the reflected light beam moves in a vertical direction, as illustrated in FIG. 1, the difference between the signals I1 and I2 changes. With the target at the position X2, the position of the reflected light beam on PSD 12 is shown at Y2. The displacement between Y1 and Y2 corresponds to the difference between X1 and X2. It is known in the prior art to electronically process the change of the current signals I1 and I2 to generate distance measurement related signals. The position Y of the light beam on the surface of PSD 12 satisfies the following equation:

$$Y = \frac{I1 - I2}{I1 + I2}$$

In the prior art to accomplish the signal division required to determine the distance X, the most common processing circuitry includes logarithmic operational amplifiers. The current signals I1 and I2 are amplified and converted to voltages V1 and V2, respectively. The division of the two voltages is accomplished with the use of logarithmic conversion according to the following formula $$\frac{V2}{V1} = \log V2 - \log V1$$

This implementation requires the use of bipolar transistors or diodes in the feedback path of amplifiers resulting in matching, stability and temperature compensation problems. Furthermore, since the relatively inexpensive CMOS processes do not include floating bipolar transistors or diodes, the integration of a log-based architecture would require a large number of external components resulting in a large pin count and consequently large PC board area. This results in a larger minimum package size for the sensor. In general, the integrated circuit (IC) area required to implement log-based architecture in the circuitry for the required signal processing is greater than that in the present invention. The signal processing system and method of the present invention addresses these shortcomings in the prior art. The circuit architecture of the present invention is fully compatible with inexpensive CMOS processes for IC integration. The number of components external to the IC is minimized, leading to smaller packaging requirements.

SUMMARY OF THE INVENTION

In one embodiment, the present invention is a signal processing system and method where first and second analog voltage signals are generated. The first analog voltage signal is then used to generate a current signal. A capacitor is charged with the current signal and the voltage on the capacitor is compared with the second analog voltage signal and a signal is then generated having a time interval that represents the division of the first and second analog voltage signals. In another embodiment, the signal processing circuit and method generates first and second analog voltage signals. The first analog voltage signal is used to generate a first current signal and the second analog voltage signal generates a second current signal. A first capacitor is charged with the first current signal and the voltage on that capacitor is compared with a predetermined reference voltage and an output signal having a time interval representing the time required to charge the first capacitor to a voltage exceeding the reference voltage is generated. That output signal controls the charging of a second capacitor with the second current signal in the time interval whereby the voltage on the second capacitor then represents the multiplication of the first and second analog voltage signals.

The present invention is based upon the following principle. The current I required to charge a capacitor C to a voltage ΔV in a time ΔT, is defined as:

$$I = C(\Delta V/\Delta T)$$

This formula can be rewritten as:

$$T = C(\Delta V/I)$$

With I=V1/R, where V1 is the magnitude of a continuous input voltage V1 sampled at time $t_S$ and with ΔV=V2, where V2 is the magnitude of a continuous input voltage V2 sampled at time $t_S$, then the following formula applies:

$$\Delta T = C \times R \times (V2/V1)$$

Thus, ΔT is the result of the division of V2/V1 multiplied by a constant. This result is valid for any system where the maximum rate of change of V1 and V2 is less than the minimum ΔT required to represent this change. The result, ΔT, can easily be converted into an analog voltage level for standard analog signal processing, or it can be used in its current form for a wide range of digital signal processing. A similar calculation leads to the result that $\Delta V=A(V1\times V2)$ where ΔV is the voltage to which the capacitor is charged in the interval ΔT and represents the multiplication of the two voltages V1 and V2 with a constant multiplying factor A.

In the application of the signal processing system and method of the present invention to optical triangulation distance measurement, the two analog signals are voltage signals representing the currents I1 and I2 from the PSD. The two analog voltage signals are pulsed signals which are then converted to DC signals by sample and hold circuits which sample each voltage signal with the occurrence of each light pulse from the light emitting diode of the system. One of the two analog DC voltage signals is converted to a current signal which is used to charge a divider capacitor. A divider comparator has one input connected to the capacitor and a second input connected to the other of the DC analog voltage signals. The output of the comparator is a signal having a time interval that represents the division of the first and second analog voltage signals. The system has a range adjustment circuit that generates a signal representing the sensor range. A decoder has an input connected to the output of the divider comparator and a second input receiving the range signal from the range adjustment circuit. The decoder then generates an output signal that represents whether or not the target is within the preset range of the system. The divider capacitor is discharged with the occurrence of each light pulse of the light emitting diode. In this embodiment the distance to the target that is a function of the subtraction of the two analog voltage signals divided by the sum of the two signals is simplified to a division of the two analog voltage signals without significant loss in accuracy.

The present invention can be applied to optical triangulation and distance measurement by inexpensive CMOS processes for an application specific integrated circuit (ASIC). The present invention minimizes the requirements for components external to the integrated circuit, thereby also minimizing the package size requirements. The present invention also has an advantage over the prior art of a wide dynamic range, temperature stability, and high noise immunity. The present invention also eliminates the need for bipolar matching requirements in circuitry and provides gain stability under varying signal conditions. The present invention has low power requirements and wide range adjustment capability. These and other advantages of the present invention will become apparent with reference to the accompanying drawings, detailed description of the preferred embodiments, and the claims.

DETAILED DESCRIPTION OF THE PREFERRED EMBODIMENT

Figure 1:
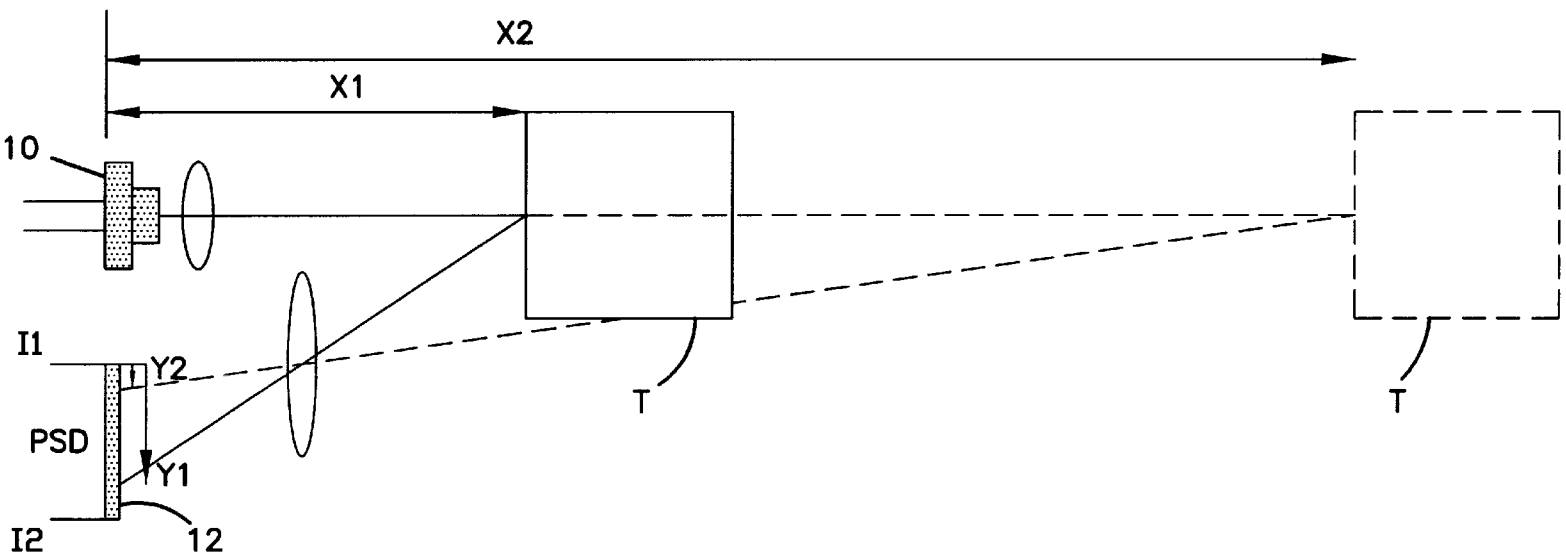
FIG. 1 is a diagrammatic illustration of an optical triangulation measurement system well known in the prior art.
Figure 2:
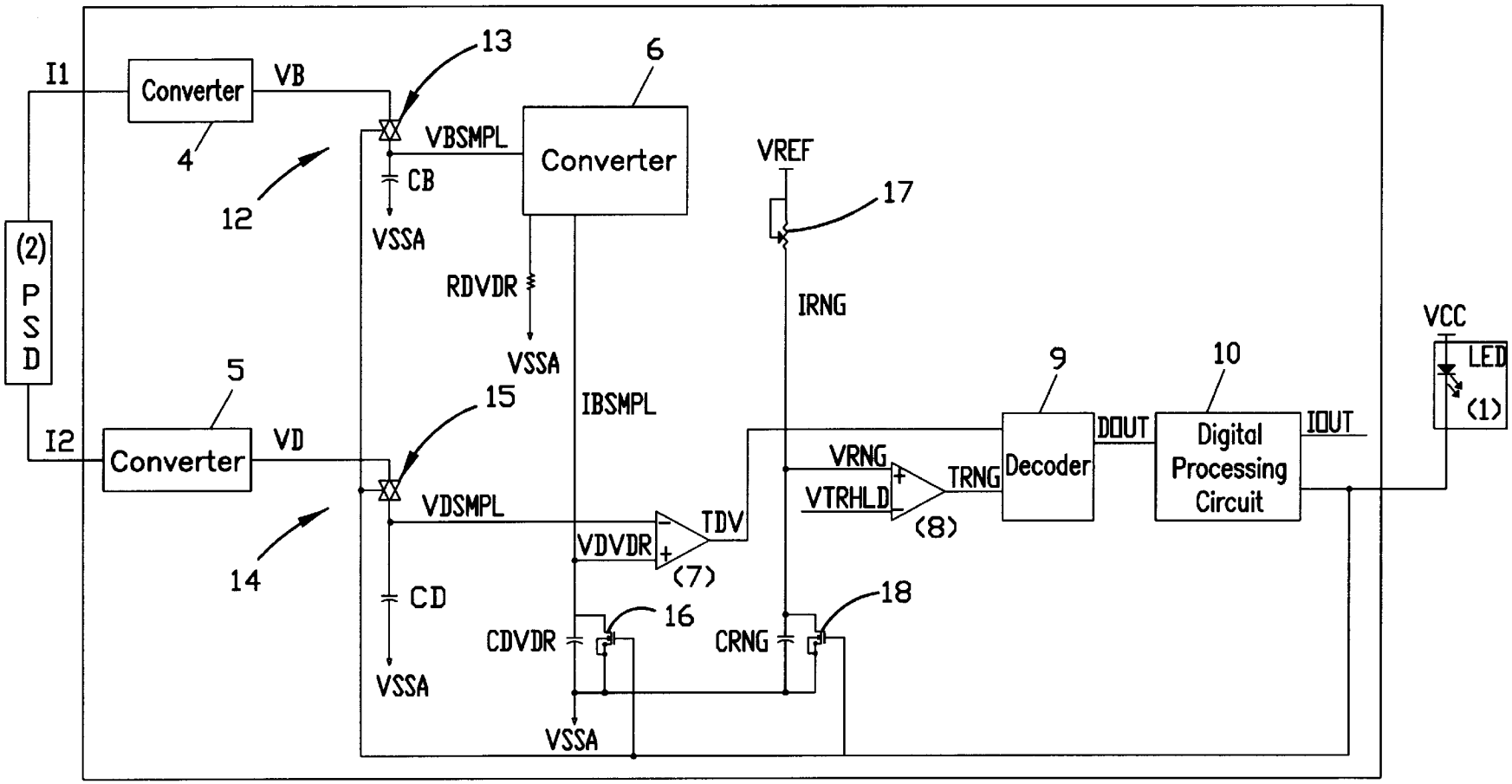
FIG. 2 is a circuit diagram illustrating one embodiment of the present invention in an optical triangulation distance measurement system.

An optical triangulation distance measurement system incorporating one embodiment of the present invention is shown in FIG. 2. The system includes a light emitting diode (1) which generates a pulse modulated light beam as is well known in the prior art. Typically the modulated light beam is in the infrared range but other light sources such as laser diodes may be used. The pulse modulated light beam is directed toward a target as previously described with respect to FIG. 1 and light reflected from the target impinges upon a lateral effect photo diode or position sensitive detector (PSD)(2). A pair of pulse current signals I1 and I2 are generated based upon the position of the reflected light beam on the surface of the PSD(2). A circuit (4) amplifies, filters and converts the pulse signal I1 to a pulse voltage signal VB. (See FIG. 3.) A circuit (5) similarly converts the pulse current signal I2 to a pulse voltage signal VD. The maximum amplitudes of the signals VD and VB represent the maximum amplitudes of the corresponding signals I1 and I2. Circuits (4) and (5) are current to voltage converter circuits well known in the prior art. The signal VB is the input to a sample and hold circuit designated generally at 12. A solid-state switch 13, for example, a field effect transistor and a capacitor CB form sample and hold circuit 12. Similarly, the signal VD is the input to a sample and hold circuit designated generally at 14. A solid state switch 15, such as a field effect transistor, and a capacitor CD form sample and hold circuit 14. The solid state switches 13 and 15 are connected to the pulse output circuit of LED (1) whereby the signals VB and VD are sampled upon occurrence of each LED pulse. The output of sample and hold circuit 12 is a DC voltage signal whose amplitude corresponds to the maximum amplitude of the pulse signal VB. The output of sample and hold circuit 14 is also a DC signal whose amplitude corresponds to the maximum amplitude of the signal VD. The DC output voltage signals of sample and hold circuits 12 and 14 are designated VBSMPL and VDSMPL, respectively. A voltage to current converter circuit (6) has one input connected to the signal VBSMPL and another input connected through a resistor RDVDR to a ground VSSA. Voltage to current converter circuit (6) is a conventional such circuit well known in the prior art. The output of voltage to converter circuit (6) is a DC current signal IBSMPL. The output signal IBSMPL is connected to a capacitor CDVDR which in turn is connected to ground VSSA. The current signal IBSMPL charges capacitor CDVDR to a voltage represented by the signal VDVDR. This signal is one input to a divider comparator (7). The other input to divider comparator (7) is the signal VDSMPL. A solid-state switch 16, such as a field effect transistor is connected across capacitor CDVDR. Solid-state switch 16 is connected to the output pulse signal from LED (1) to discharge capacitor CDVDR upon occurrence of each pulse emitted by LED (1).

The output of divider comparator (7) is a signal TDV having a time interval ΔT corresponding to the time required to charge the capacitor CDVDR to a voltage equal to the signal VDSMPL. The time interval ΔT is the interval between the falling edge of the pulse from LED (1) and the rising edge of the output of divider comparator (7). This time interval represents the division of the voltage signals VDSMPL and VBSMPL. The time interval is determined by the following formula:

$$\Delta T = RDVDR \times CDVDR \times \frac{VDSMPL}{VBSMPL}$$

A range adjustment circuit comprises a variable resistor 17 and a capacitor CRNG connected to a reference voltage VREF. A solid-state switch 18 such as a field effect transistor, is connected to capacitor CRNG and the output pulse signal from LED (1) to discharge the capacitor CRNG upon occurrence of each pulse emitted by LED (1). Capacitor CRNG is charged to a voltage by the current signal IRNG. The voltage on capacitor CRNG is represented by the signal VRNG which is one input to a range comparator (8). The other input of range comparator (8) is a threshold voltage VTRHLD. The output of range comparator (8) changes states when the signal VRNG exceeds the voltage VTRHLD. The output of range comparator (8) is a binary signal TRNG. This signal is the input to a digital decoder (9). The signal TDV is also an input to a digital decoder (9). The signals TVD and TRNG are digitally compared by decoder (9). Circuitry that comprises decoder (9) is well known in the prior art.

The output of decoder (9) is the signal DOUT which is the binary signal whose state depends on whether or not the target is within the range or out of range of the system. Specifically, if TRNG is less than TDVDR, DOUT=binary 1 indicating that the target is within range. If TRNG is greater than TDVDR, DOUT=binary 0 indicating that the target is out of range. Signal DOUT is the input to the further processing circuit (10) which generates a signal IOUT also representing whether or not the target is within the range set by the range adjustment circuit. The pulse modulated signal from LED (1) is an input to processing circuit (10).

Figure 3:
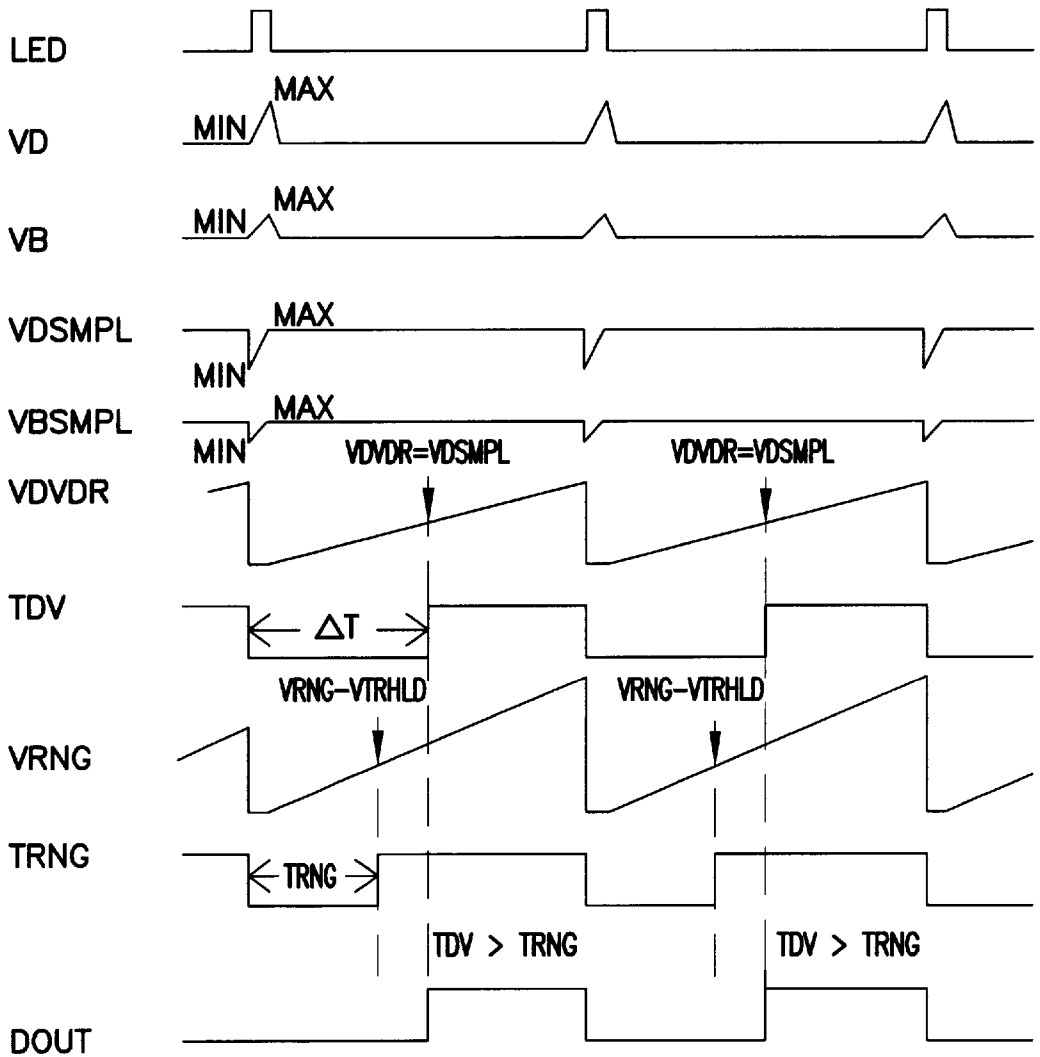
FIG. 3 is a signal timing diagram illustrating the operation of the circuit of FIG. 2.

The embodiment of the invention illustrated in FIGS. 2 and 3 operates on the principle that the charging of capacitor CDVDR is, in effect, a division of the voltage signals VDSMPL and VBSMPL. The time interval ΔT is a function of the division of the two voltage signals according to the above formula.

Figure 4:
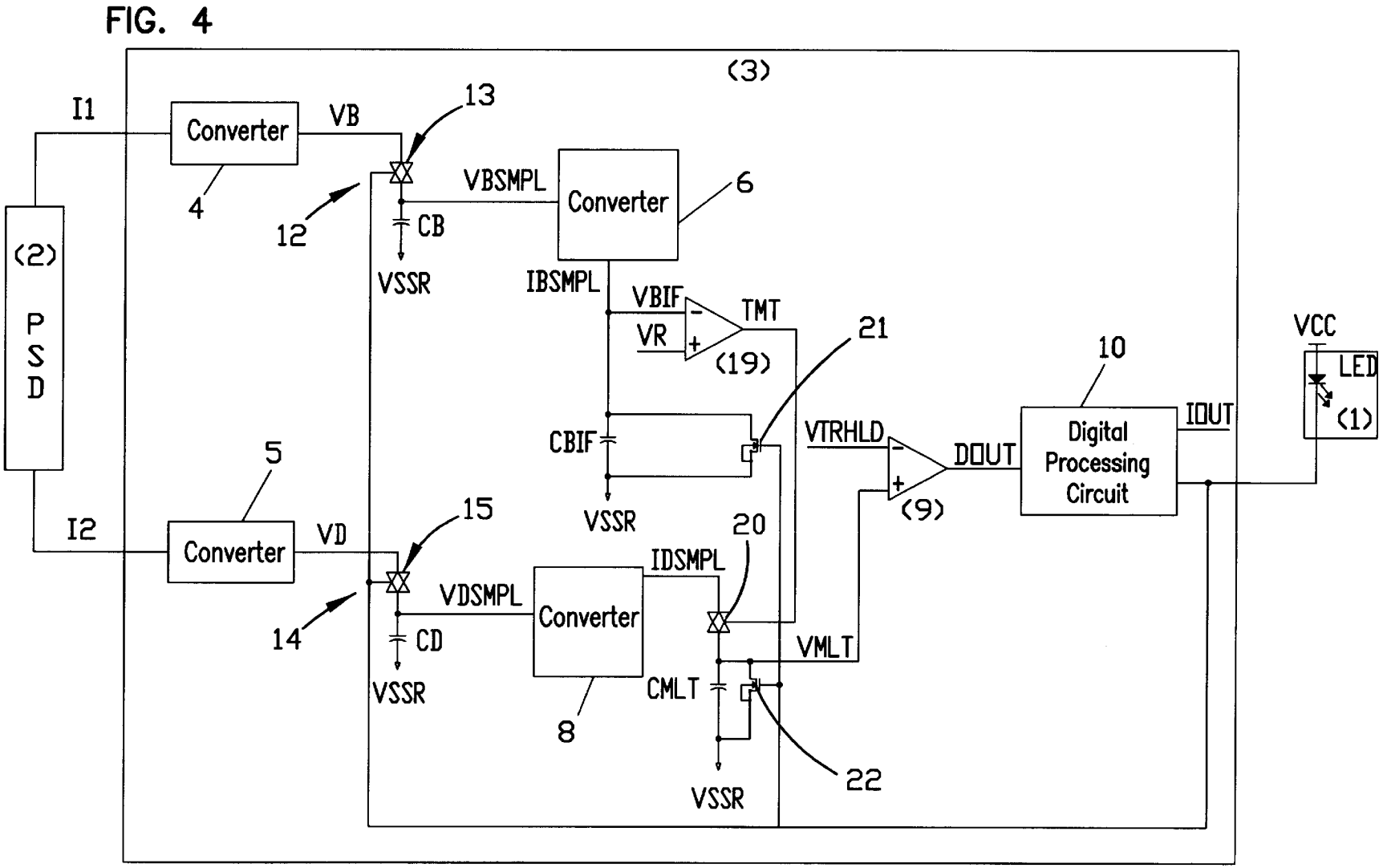
FIG. 4 is a circuit diagram of an alternative embodiment of the present invention incorporated in an optical triangulation distance measurement system.
Figure 5:
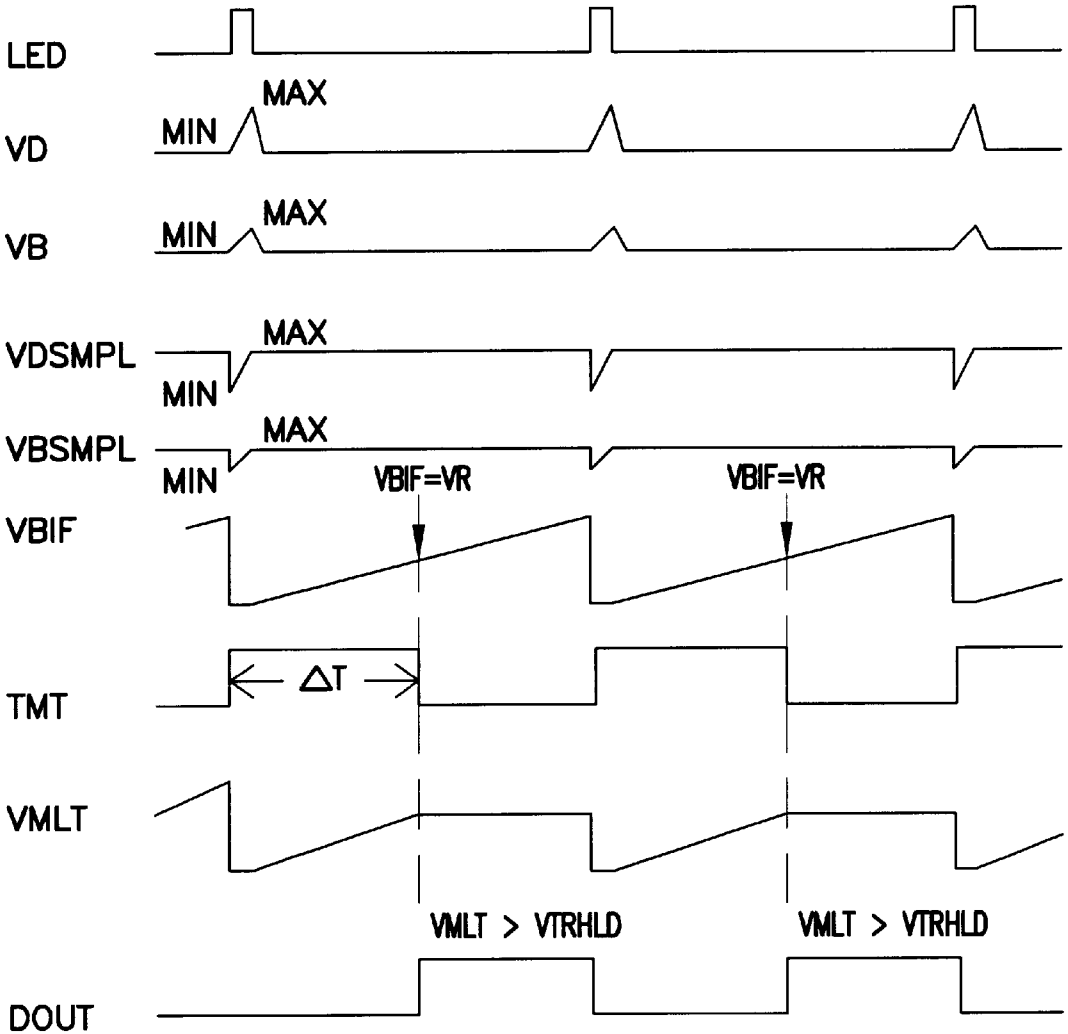
FIG. 5 is a signal timing diagram illustrating the operation of the circuit of FIG. 4.

FIGS. 4 and 5 illustrate an embodiment of the present invention operating under the principles of multiplication of two voltage signals. In this embodiment, circuits (4) and (5) and sample and hold circuits 12 and 14 function in the same manner as previously described with reference to FIGS. 1 and 2. Similarly the voltage to current converter circuit (6) generates a DC current IBSMPL to charge a capacitor CBIF. The voltage appearing on capacitor CBIF is the signal VBIF as shown in FIG. 5 and is an input to the multiplier time comparator (19). The other input to a comparator (19) is a constant voltage VR. The output of multiplier time comparator (19) is a binary signal TMT as shown in FIG. 5.

When the voltage on capacitor CBIF exceeds the reference voltage VR the output signal TMT of multiplier time comparator changes state. The time interval between the falling edge of an emitter pulse from LED (1) and the falling edge of the output of comparator (19) is the time interval ΔT as shown in FIG. 4. The output of comparator (19) is connected to a solid-state switch 20 to control the operation of the switch. Solid-state switch 20 may be any well known device such as a field effect transistor. The signal VDSMPL is converted to a current signal IDSMPL by a conventional and well known voltage to current converter circuit (8). The current signal IDSMPL functions to charge a capacitor CMLT during the time interval ΔT. The voltage signal VMLT developed across capacitors CMLT within the time interval ΔT is a function of multiplication of the signals VBSMPL and VDSMPL. The signal VMLT is one input to a range comparator (9). The other input to comparator (9) is an adjustable range threshold voltage VTRHLD. The output of comparator (9) is a binary signal DOUT. When the signal VMLT is greater than the threshold VTRHLD, the output of comparator (9) is a binary 1. When the signal VMLT is less than the threshold VTRHLD, the signal DOUT is a binary 0. The signal DOUT is the input to a further signal processing circuit (10) which processes the binary information from signal DOUT to provide an output signal IOUT representing whether or not the target is within range or out of range. Any well known digital processing circuit could be used as a processing circuit (10). Capacitors CBIF and CMLT have associated solid-state discharge switches 21 and 22, respectively, which may be any one of a number of well known solid-state switching devices. Solid-state switches 21 and 22 are connected to the output pulse signal from LED (1) so that upon occurrence of each LED pulse, capacitors CBIF and CMLT are discharged and reinitialized with the voltages across the two capacitors returning to 0 volts.

In this embodiment, the voltage VMLT is defined by the formula:

$$VMLT = \frac{IDSMPL \times \Delta T}{CMLT}$$

As stated above, the preferred embodiments of the present invention have been described with respect to the application of the signal processing to optical triangulation distance measurement systems. It should be understood that the processing of signals to produce signals representing the division or multiplication of analog signals could be readily adapted to other systems requiring the division or amplification of analog signals. In addition to the advantages of the application of the present invention in the field of optical triangulation distance measurement, other advanced applications are possible. For example, the output of the divider and multiplier circuits could be oversampled by a microprocessor for accurate distance measurement without the use of analog to digital converters. Such an application would result in even greater size and cost reduction. Also, the range could be adjusted by a microprocessor eliminating the need for variable resistors and other components associated with the range adjustment circuitry of the two systems. Application of a microprocessor to accomplish these functions in an advanced application of the present invention would be within the ordinary skill in the art.

I claim:

1. A circuit for generating a signal representing the division of first and second analog voltage signals comprising:

a first sample and hold circuit with an input receiving the first analog voltage signal and an output;

a second sample and hold circuit with an input receiving the second analog voltage signal and an output;

a voltage to current converter having an input connected to the output of said first sample and hold circuit and generating an output current signal corresponding to the first analog voltage signal;

a capacitor connected to the voltage to current converter whereby said output current signal charges said capacitor;

a comparator having a first input connected to said capacitor and a second input connected to said output of said second sample and hold circuit and generating an output signal having a time interval representing the division of the first and second analog voltage signal; and means connected to said capacitor for discharging said capacitor with each cycle of sampling of the first and second sample and hold circuits.

2. A photoelectric sensor for optical distance measurement comprising:

a light emitting diode generating a pulsed light;

a photoreceiver means for receiving said pulsed light reflected from a target, said photoreceiver means generating first and second current signals according to the position of said deflected light on said photoreceiver means;

a first processing circuit converting said first current signal to a first voltage signal;

a second processing circuit converting said second current signal to a second voltage signal;

a first sample and hold circuit sampling said first voltage signal with the occurrence of each light pulse from said light emitting diode;

a second sample and hold circuit sampling said second voltage signal with the occurrence of each light pulse from said light emitting diode;

a voltage to current converter having an input connected to the output of said first sample and hold circuit and generating an output current signal corresponding to said first voltage signal;

a divider capacitor connected to the voltage to current converter whereby said output current signal charges said capacitor;

a divider comparator having a first input connected to said capacitor and a second input connected to said output of said second sample and hold circuit and generating an output signal having a time interval representing a division of said first and second voltage signals;

range adjustment circuit means for generating a signal representing the range of the sensor;

a decoder having one input connected to the output of said divider comparator and a second input receiving said range signal and generating an output signal representing whether or not the target is within range;

circuit means connected to said divider capacitor for discharging said divider capacitor with the occurrence of each light pulse from the light emitting diode.

3. A photoelectric sensor in accordance with claim 2 wherein said range adjustment circuit means comprises:

a range capacitor and variable resistor in series connected to a reference voltage source for charging said range capacitor; and a second comparator having one input connected to said range capacitor and a second input connected to a threshold voltage for comparing the voltage on said range capacitor with said threshold voltage and generating a range signal having a time interval representing the range of the sensor.

4. A photoelectric sensor in accordance with claim 2 wherein said range adjustment circuit means further comprises digital circuit means for generating said range signal.

5. A photoelectric sensor in accordance with claim 2 wherein said photoreceiver means comprises a lateral effect photodiode.

* * * * *